US011903485B1

(12) United States Patent
Lawson et al.

(10) Patent No.: US 11,903,485 B1
(45) Date of Patent: Feb. 20, 2024

(54) LIFT CHAIR MECHANISM WITH ZERO-GRAVITY POSITION OPTIONS

(71) Applicant: L&P PROPERTY MANAGEMENT COMPANY, South Gate, CA (US)

(72) Inventors: Gregory Mark Lawson, Tupelo, MS (US); Vasile Ioan Bratan, Mantachie, MS (US)

(73) Assignee: L&P PROPERTY MANAGEMENT COMPANY, South Gate, CA (US)

( * ) Notice: Subject to any disclaimer, the term of this patent is extended or adjusted under 35 U.S.C. 154(b) by 0 days.

(21) Appl. No.: 17/964,515

(22) Filed: Oct. 12, 2022

(51) Int. Cl.
*A47C 1/031* (2006.01)
*A47C 1/0355* (2013.01)
*A47C 1/024* (2006.01)

(52) U.S. Cl.
CPC ..... *A47C 1/0355* (2013.01); *A47C 1/0242* (2013.01)

(58) Field of Classification Search
CPC ..... A47C 1/0355; A47C 3/027; A47C 3/02; A47C 3/026; A47C 3/029
See application file for complete search history.

(56) References Cited

U.S. PATENT DOCUMENTS 4,662,673 A * 5/1987 Crum ..... A47C 3/027 297/68
4,707,025 A * 11/1987 Rogers, Jr. ..... A47C 1/0345 297/316
5,876,094 A * 3/1999 Hoffman ..... A47C 1/0352 297/267.1
6,000,758 A * 12/1999 Schaffner ..... A47C 1/0345 297/DIG. 10
6,634,706 B2 * 10/2003 May ..... A47C 3/027 297/270.3
6,659,556 B2 * 12/2003 Pellerin ..... A61G 5/14 297/DIG. 10
6,945,599 B2 * 9/2005 May ..... A47C 3/03 297/85 L
7,021,711 B1 * 4/2006 Hoffman ..... A47C 3/027 297/270.3
7,497,512 B2 * 3/2009 White ..... A47C 1/0355 297/89
7,543,885 B2 * 6/2009 Pollard ..... A47C 1/024 297/69
8,113,574 B2 * 2/2012 Hoffman ..... A47C 3/18 297/85 L
8,398,165 B2 * 3/2013 Lawson ..... A47C 3/027 297/259.2

(Continued)

OTHER PUBLICATIONS

International Search Report and Written Opinion received for PCT Application No. PCT/US2023/076050, dated Nov. 15, 2023, 6 pages.

*Primary Examiner* — Shin H Kim
(74) *Attorney, Agent, or Firm* — Shook, Hardy & Bacon L.L.P.; Scott Strohm

(57) ABSTRACT

A lift and recliner mechanism for use in seating units is provided that allows the ottoman to be extended independently of the back recline. In some aspects, the seat pitch is changed through a linkage as the ottoman extends, and as the back reclines. In other aspects, the seat pitch is changed using a separate motor. The seating unit can be moved to a lifted position, a TV position, a fully-reclined position, or a zero-gravity position with the ottoman partially extended, the seat pitch partially changed and the back partially reclined.

19 Claims, 14 Drawing Sheets

(56) References Cited

U.S. PATENT DOCUMENTS 8,459,732 B2 * 6/2013 LaPointe ..... A47C 1/0355 297/260.2
8,459,733 B2 * 6/2013 Hoffman ..... A47C 3/18 297/DIG. 7
8,616,627 B2 * 12/2013 Murphy ..... A47C 1/0355 297/85 L
8,727,433 B2 * 5/2014 Lawson ..... A47C 1/0355 297/DIG. 10
8,752,890 B2 * 6/2014 Murphy ..... A47C 1/037 297/423.35
8,833,844 B2 * 9/2014 LaPointe ..... A47C 1/0355 297/DIG. 7
8,911,009 B2 * 12/2014 Hoffman ..... A47C 1/03272 297/75
8,967,718 B2 * 3/2015 Hoffman ..... A47C 1/03272 297/341
9,351,890 B2 * 5/2016 Hough ..... A61G 5/1005
9,700,140 B2 * 7/2017 Lawson ..... A47C 1/0345
9,743,770 B1 * 8/2017 Pollard ..... A47C 1/0355
10,349,748 B2 * 7/2019 Marquez ..... A47C 7/02
10,512,333 B2 * 12/2019 Lawson ..... A63J 3/00
10,653,243 B2 * 5/2020 Lawson ..... A47C 1/03211
10,709,246 B2 * 7/2020 Murphy ..... A47C 1/0345
10,750,869 B2 * 8/2020 Robinson ..... A47C 1/034
11,134,781 B2 * 10/2021 Robinson ..... A47C 1/02
11,241,094 B2 * 2/2022 Murphy ..... A47C 3/0255
11,266,245 B2 * 3/2022 Lawson ..... A47C 1/0355
11,766,124 B2 * 9/2023 Crawford ..... A47C 1/0355 297/85 R
2004/0000803 A1 * 1/2004 Guillot ..... A47C 1/0355 297/270.1
2009/0174251 A1 * 7/2009 Lawson ..... A47C 1/0355 297/316
2010/0127538 A1 * 5/2010 Hoffman ..... A47C 3/18 297/68
2012/0112517 A1 * 5/2012 Hoffman ..... A47C 1/0355 297/85 L
2012/0112518 A1 * 5/2012 Murphy ..... A47C 1/0355 297/85 L
2012/0146364 A1 * 6/2012 Hoffman ..... A47C 1/03266 297/84
2013/0200659 A1 * 8/2013 Hoffman ..... A47C 1/035 297/84
2014/0327282 A1 * 11/2014 Crum ..... A47C 3/026 297/259.2
2015/0076881 A1 * 3/2015 LaPointe ..... A47C 1/032 297/316
2016/0106220 A1 * 4/2016 Bryant ..... A47C 3/027 297/423.28
2018/0027968 A1 * 2/2018 Lawson ..... A47C 1/0355
2019/0290004 A1 * 9/2019 Lawson ..... A47C 1/0355
2020/0275781 A1 * 9/2020 Lawson ..... A47C 3/029
2021/0386202 A1 * 12/2021 Crum ..... A47C 3/027
2022/0346552 A1 * 11/2022 Crawford ..... A47C 1/0355

* cited by examiner

LIFT CHAIR MECHANISM WITH ZERO-GRAVITY POSITION OPTIONS

BACKGROUND

The present invention relates broadly to motion furniture and motion furniture mechanisms. More particularly, the present invention relates to an improved lift and reclining mechanism that offers a user the option of a zero-gravity position.

Mechanisms for seating units known as lift chairs are available to assist users getting into and out of the seating unit. In these lift chairs, the seat and back of the seating unit can be lifted from a generally horizontal position (used for sitting) to an elevated position. This elevated position helps a user out of the chair, in that the user does not have to supply all of the strength needed to stand from a completely seated position. Similarly, with the seat and back in the elevated position, a user can ease into the seated position. These lift chairs are also known to have recliner mechanisms that allow the seating unit to move from a closed position, to a TV position with an ottoman extended forwardly, to a fully-reclined position with the ottoman extended and the back reclined. It would be beneficial to offer such a lift and reclining chair that allowed the ottoman and the backrest to be independently adjusted; to adjust the seat pitch as the seating unit moves from closed to TV to fully-reclined; and to allow the option of a zero-gravity position using simple motors that do not require extensive programming.

BRIEF SUMMARY OF THE INVENTION

Accordingly, one aspect of the present invention seeks to provide a seating unit with a powered lift chair mechanism. At a high level, the mechanism allows the seating unit to move from a lowered, closed position to an elevated or lifted position. Additionally, the mechanism allows the ottoman and the back of the seating unit to each be independently adjusted. The seat pitch either changes as the ottoman is extended and the back is reclined, or the seat pitch can also be independently adjusted. By adjusting the ottoman, the backrest and changing the seat pitch, a zero-gravity position can be attained, using only simple motors. In providing a mechanism with selected pivot points aligned in selected positions, the ottoman and backrest can be independently adjusted using only simple motors, without any binding or interference among the links of the mechanism.

This summary is provided to introduce a selection of concepts in a simplified form that are further described below in the detailed description. This summary is not intended to identify key features or essential features of the claimed subject matter, nor is it intended to be used as an aid in determining the scope of the claimed subject matter.

BRIEF DESCRIPTION OF THE SEVERAL VIEWS OF THE DRAWING

In the accompanying drawings which form a part of the specification and which are to be read in conjunction therewith, and in which like reference numerals are used to indicate like parts in the various views.

DETAILED DESCRIPTION OF THE INVENTION

The subject matter of aspects of the present invention is described with specificity herein to meet statutory requirements. However, the description itself is not intended to limit the scope of this patent. Rather, the inventors have contemplated that the claimed subject matter might also be embodied in other ways, to include different features or combinations of features similar to the ones described in this document, in conjunction with other present or future technologies. Further, it should be appreciated that the figures do not necessarily represent an all-inclusive representation of the embodiments herein and may have various components hidden to aid in the written description thereof.

Aspects hereof may be described using directional terminology. For example, the Cartesian coordinate system may be used to describe positions and movement or rotation of the features described herein. Accordingly, some aspects may be described with reference to three mutually perpendicular axes. The axes may be referred to herein as lateral, longitudinal, and vertical. For example, the terms "vertical" and "vertically" as used herein refer to a direction perpendicular to each of the lateral and longitudinal axes. As a further example, the longitudinal axis may extend in a front-to-back direction of a seating unit and the lateral axis may extend in a side-to-side direction of the seating unit. Additionally, relative location terminology will be utilized herein. For example, the term "proximate" is intended to mean on, about, near, by, next to, at, and the like. Therefore, when a feature is proximate another feature, it is close in proximity but not necessarily exactly at the described location, in some aspects. Additionally, the term "distal" refers to a portion of a feature herein that is positioned away from a midpoint of the feature.

Figure 1:
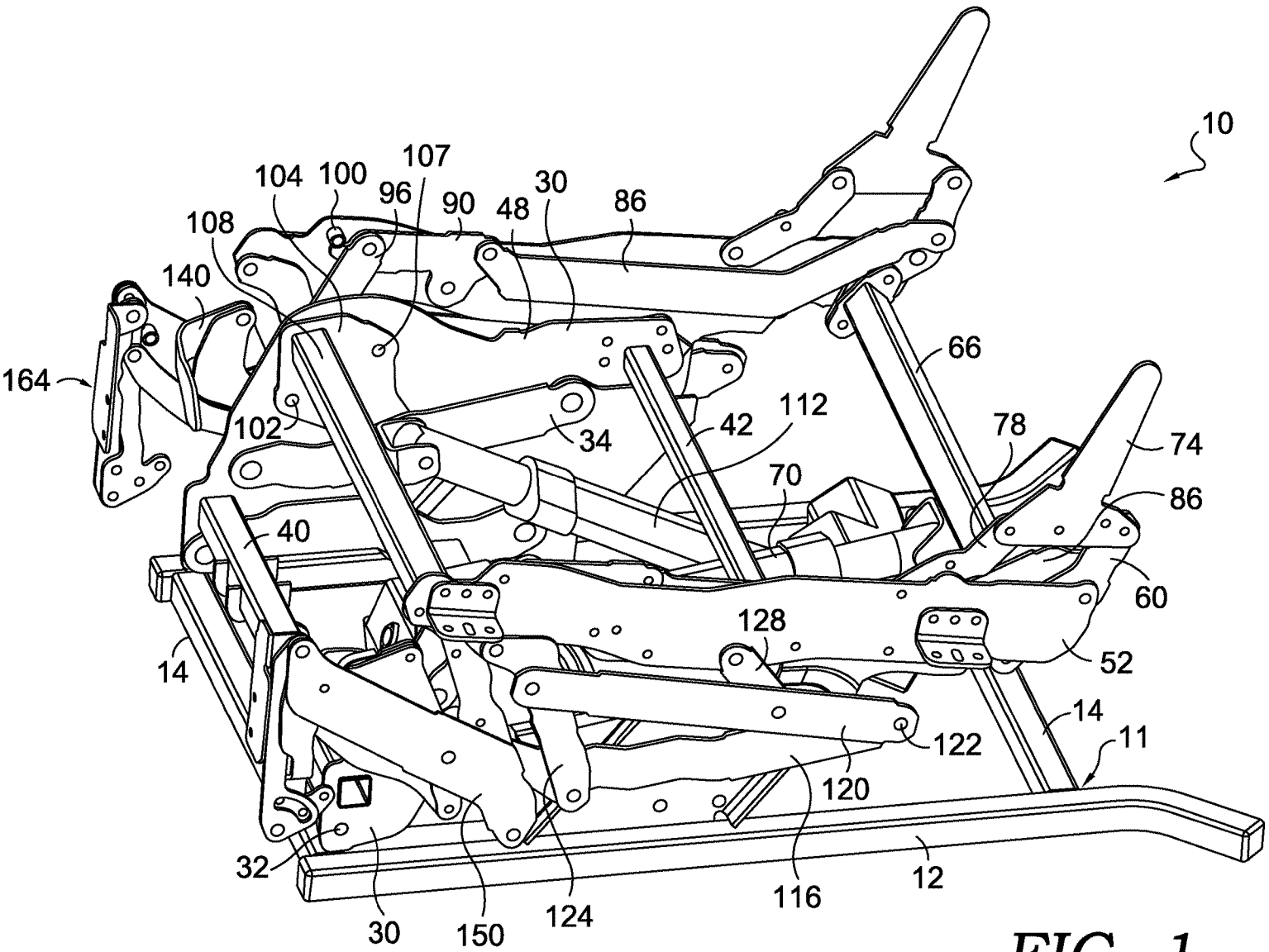
FIG. 1 is a perspective view of a two-motor mechanism in a closed position, in accordance with aspects hereof.
Figure 2:
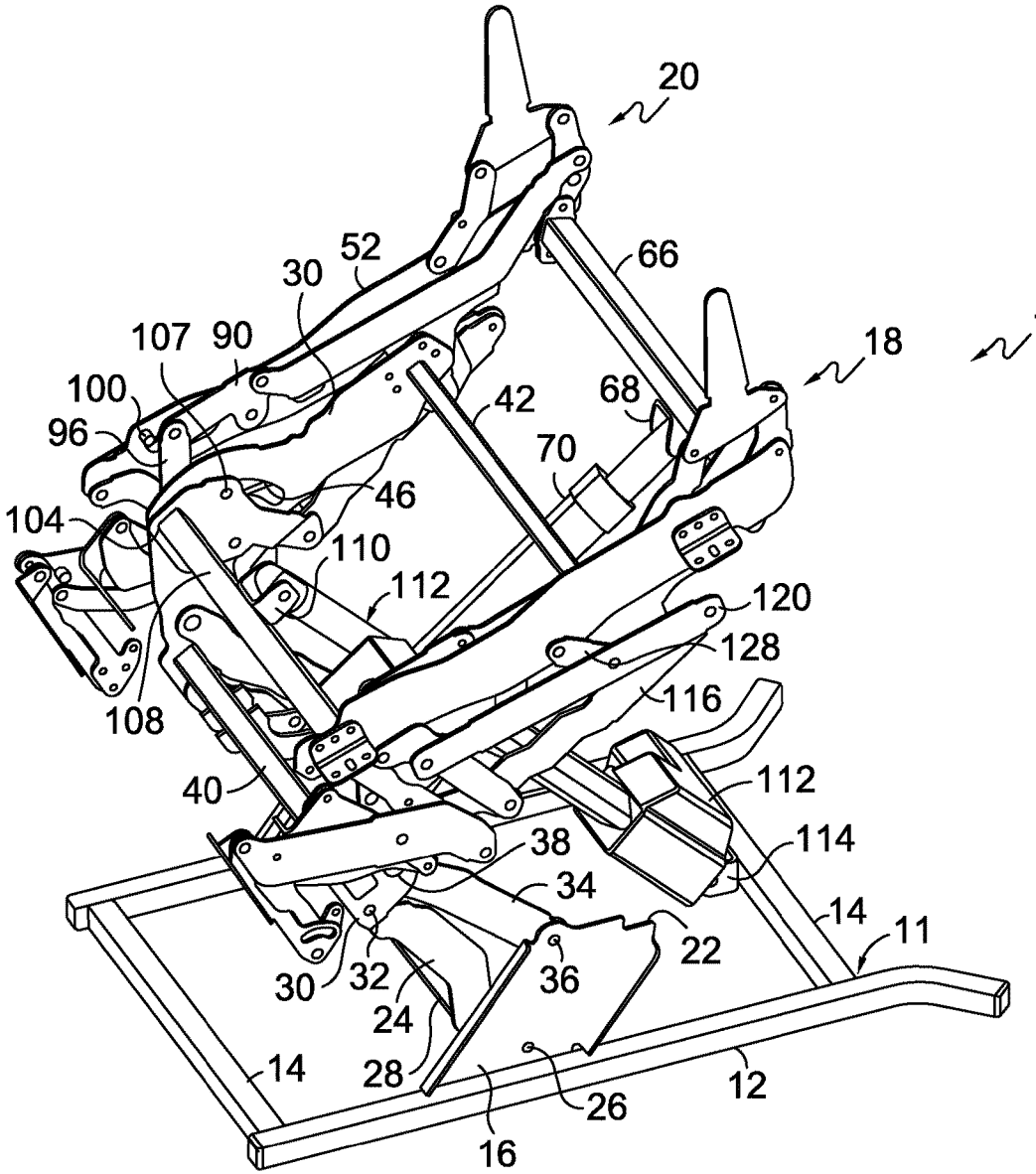
FIG. 2 is a perspective view of the mechanism of FIG. 1, in the lifted position, in accordance with aspects hereof.
Figure 3:
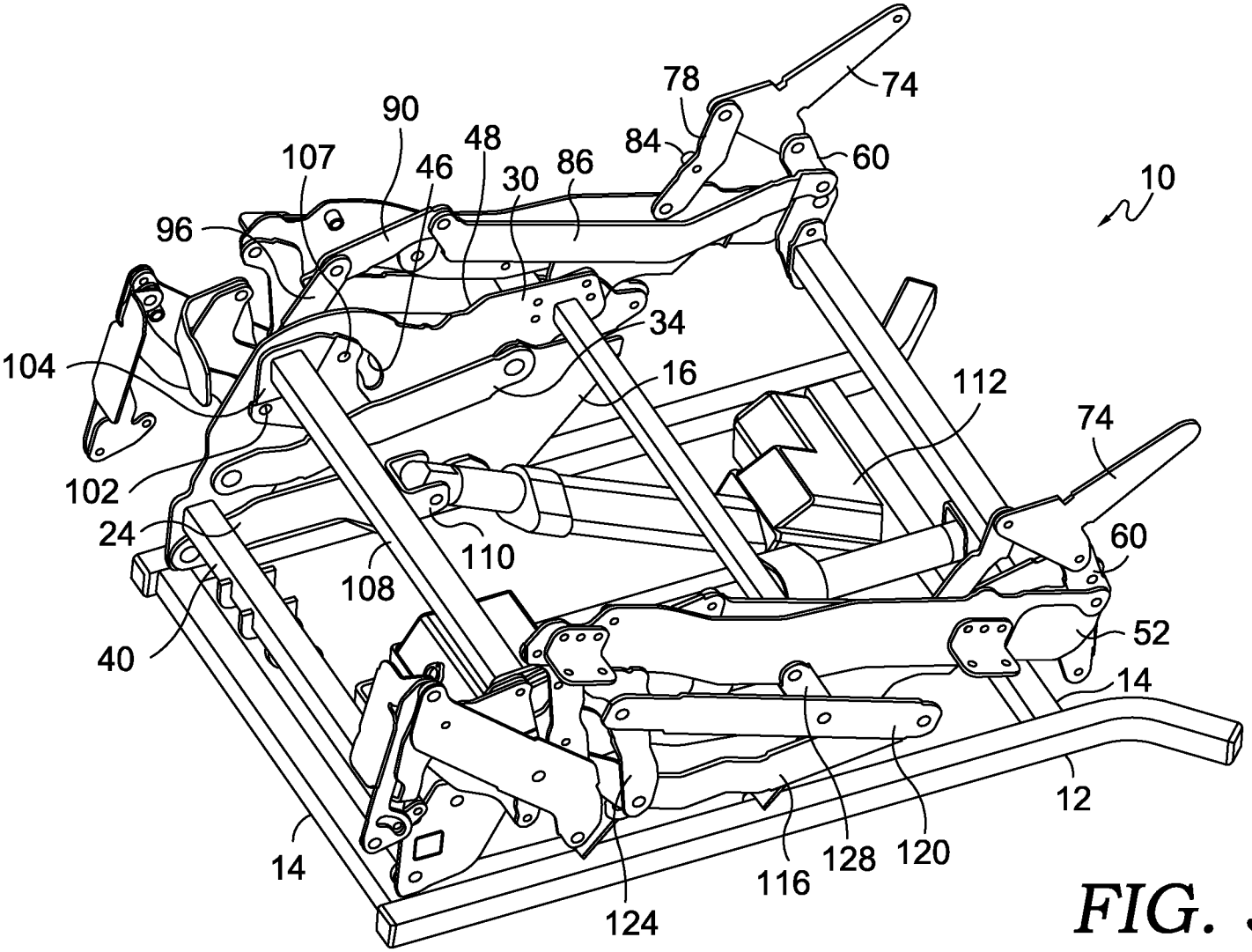
FIG. 3 is a perspective view of the mechanism of FIG. 1, with the back reclined and the ottoman closed, in accordance with aspects hereof.

FIG. 1 illustrates a mechanism 10 for a reclining, lifting seating unit. The mechanism 10 moves the seating unit between a closed position (FIG. 1), with an ottoman stowed and a generally horizontal seat and an upright back, to a TV position (FIG. 4) with the ottoman extended, the seat partially tilted and the back upright, to a fully-reclined position (FIG. 5) with the ottoman extended, the seat fully-tilted and the back reclined. As explained below, the ottoman is operable independently from the backrest. This allows the mechanism 10 to be positioned in a zero-gravity state, (FIG. 9) with the ottoman partially extended, the seat at least partially tilted, and the back reclined. From the closed position, the mechanism 10 can also lift the seat and back of the seating unit to a lifted position (FIG. 2) to assist in user in getting into, and out of, the seating unit. Because the ottoman and back are independently adjustable, a variety of other positions are also possible. As one example, the back can be reclined while the ottoman remains closed as shown in FIG. 3.

The mechanism 10 in some aspects is implemented as a two motor design, and in other aspects as a three motor design. Beginning initially with the two motor design, and as best seen in FIG. 2 with the mechanism 10 in the lifted position, the mechanism 10 includes a base 11 that has side base rails 12 spaced apart and fixedly coupled to front and rear cross-supports 14. Together, side base rails 12 and cross-supports 14 form the base 11. In some aspects, cross-supports 14 are welded to side base rails 12. In some aspects, each side rail 12 includes an outwardly angled rear end to provide additional support.

A base bracket 16 is fixedly coupled to a corresponding side base rail 12. In the remaining description, it should be understood that the mechanism 10 has a left side 18 (as experienced from a user sitting in the chair), spaced from a right side 20 (as experienced from a user sitting in the chair), and that the left side 18 is a mirror-image of the right side 20. In the description that follows, as the linkage mechanism 18, 20 on each side of mechanism 10 is described, it should be understood that the description also applies to the opposite side. The base bracket 16 is shaped as a parallelogram and extends upwardly and rearwardly from the corresponding side base rail 12 to which it is coupled. The upper, rearward end of the base bracket 16 includes a notch 22 to provide support for a cross-tube as described below. A lower lift link 24 is pivotally coupled on one end to the base bracket 16 at pivot point 26. The lower lift links 24 are also coupled to one another with a cross-support 28 that provides structural support and stability. In some aspects, cross-support 28 is welded on each end to a corresponding lower lift link 24. The other end of lower lift link 24 is pivotally coupled to a side plate 30 at pivot point 32. Similarly, an upper lift link 34 is pivotally coupled on one end to the base bracket 16 at pivot point 36. The other end of the upper lift link 34 is pivotally coupled to the side plate 30 at pivot point 38.

Figure 7:
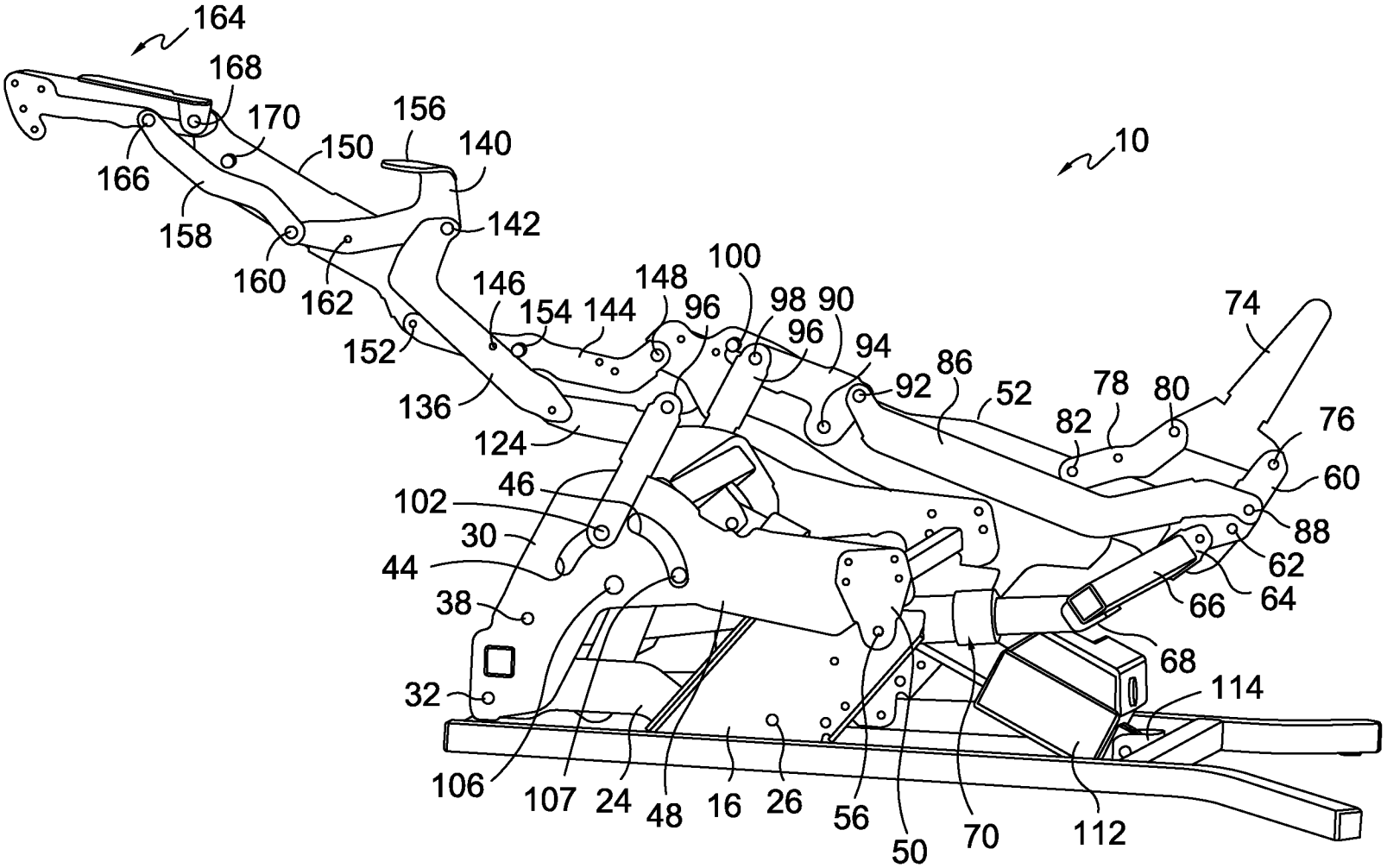
FIG. 7 is a sectioned view of FIG. 6 to reveal aspects of links not seen fully in FIG. 6, in accordance with aspects hereof.

The shape and configuration of side plate 30 is best seen in FIG. 7, in which some parts have been removed to show details of side plate 30. Side plates 30 are coupled to one another with a front cross tube 40 and a rear cross tube 42 (see FIG. 2). Front cross tube 40 and rear cross tube 42, in some aspects, are welded on each end to the corresponding side plate 30, again providing stability and support to the mechanism 10. In the closed position of FIG. 1, rear cross tube 42 rests within the notch 22 and is supported by the base bracket 16. Returning to FIG. 7, the side plate 30 has a front arcuate slot 44, with the front end of slot 44 lower than the rear end of slot 44. Similarly, side plate 30 has a rear arcuate slot 46, with the front end of slot 46 higher than the rear end of slot 46. Behind slot 46, the side plate 30 has an angled, or flared, section 48 that offsets the front of side plate 30 from the back of side plate 30, to allow clearance for base bracket 16. A pitch bracket 50 is fixedly coupled to the back end of side plate 30, and extends downwardly therefrom. In some aspects, the side plate 30 could be integrally formed with pitch bracket 50 being a part of the side plate 30.

Figure 8:
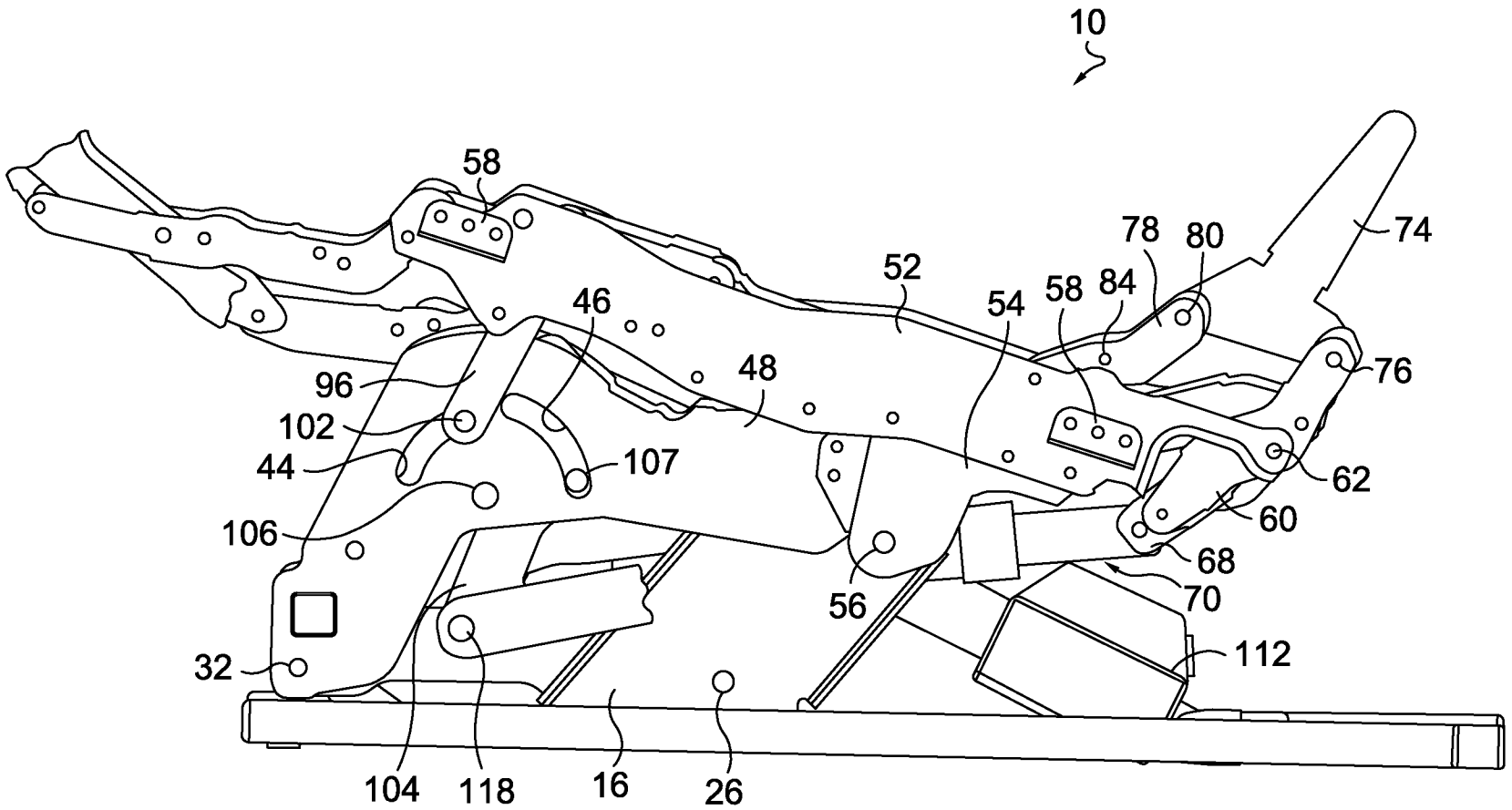
FIG. 8 is a view similar to FIG. 7, but is an enlarged, partial view, sectioned differently to show aspects of the seat plate and seat plate extension, in accordance with aspects hereof.

As shown in FIG. 8, the mechanism 10 includes a seat plate 52 that carries and supports the seat of the seating unit. In some aspects, a seat plate extension 54 is fixedly coupled to the seat plate 52 and extends downwardly therefrom. The seat plate extension 54 could, in some aspects, be integrally formed with the seat plate 52. The seat plate 52, through the seat plate extension 54, is pivotally coupled to the side plate 30, through the pitch bracket 50, at pivot point 56. Therefore, the seat plate 52 pivots with respect to the side plate 30 at pivot point 56. This allows the front of the seat plate 52 to be lifted to increase the seat pitch as the mechanism 10 moves from the closed position to the TV position and again as the mechanism moves from the TV position to the fully-reclined position. The seat plate 52 carries the seat and arms of the seating unit, and in some aspects, includes mounting brackets 58 fixedly coupled to the seat plate 52 and extending outwardly therefrom.

Figure 5:
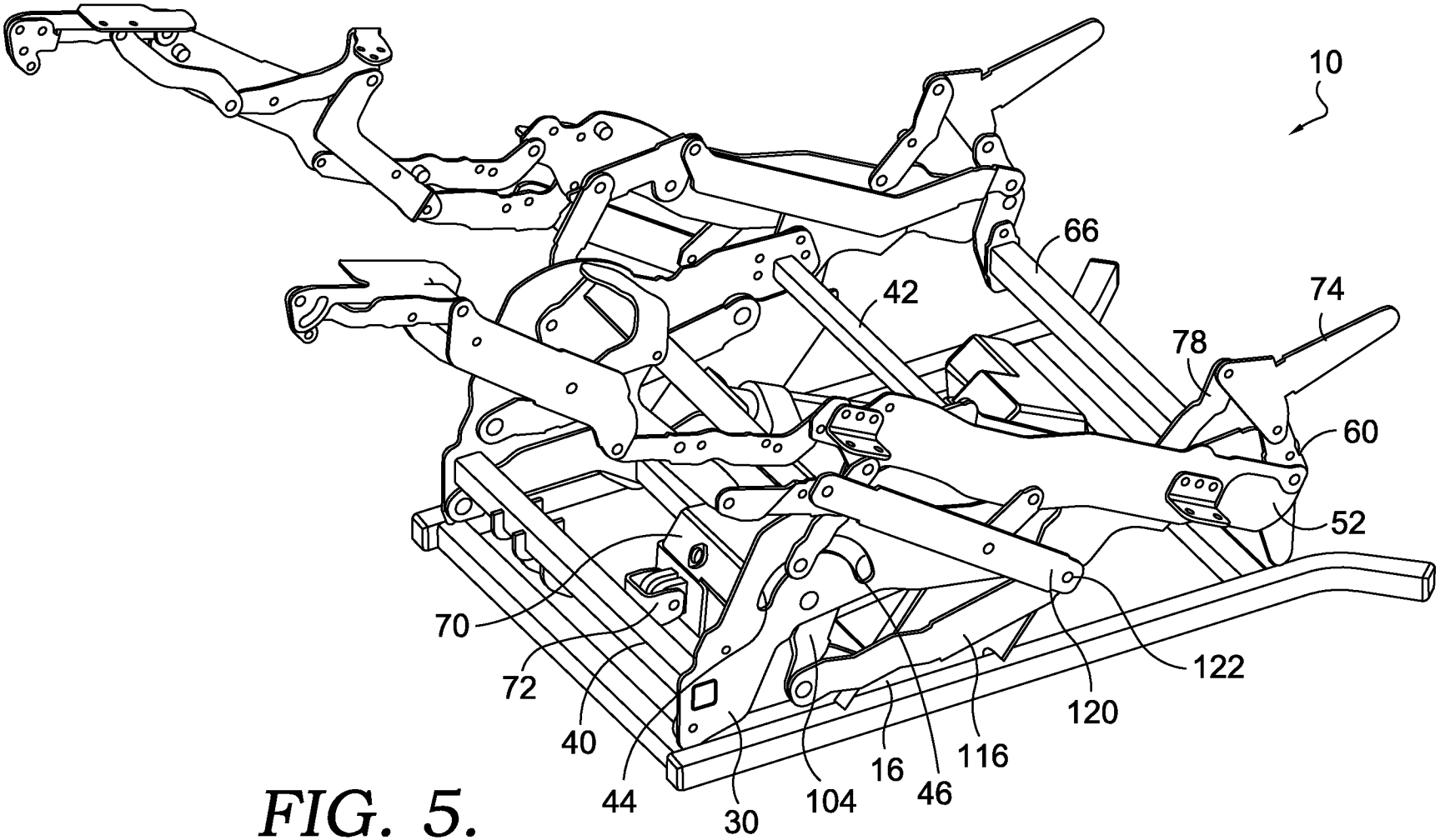
FIG. 5 is a perspective view of the mechanism of FIG. 1, in the fully-reclined position with the ottoman extended and the back reclined, in accordance with aspects hereof.
Figure 6:
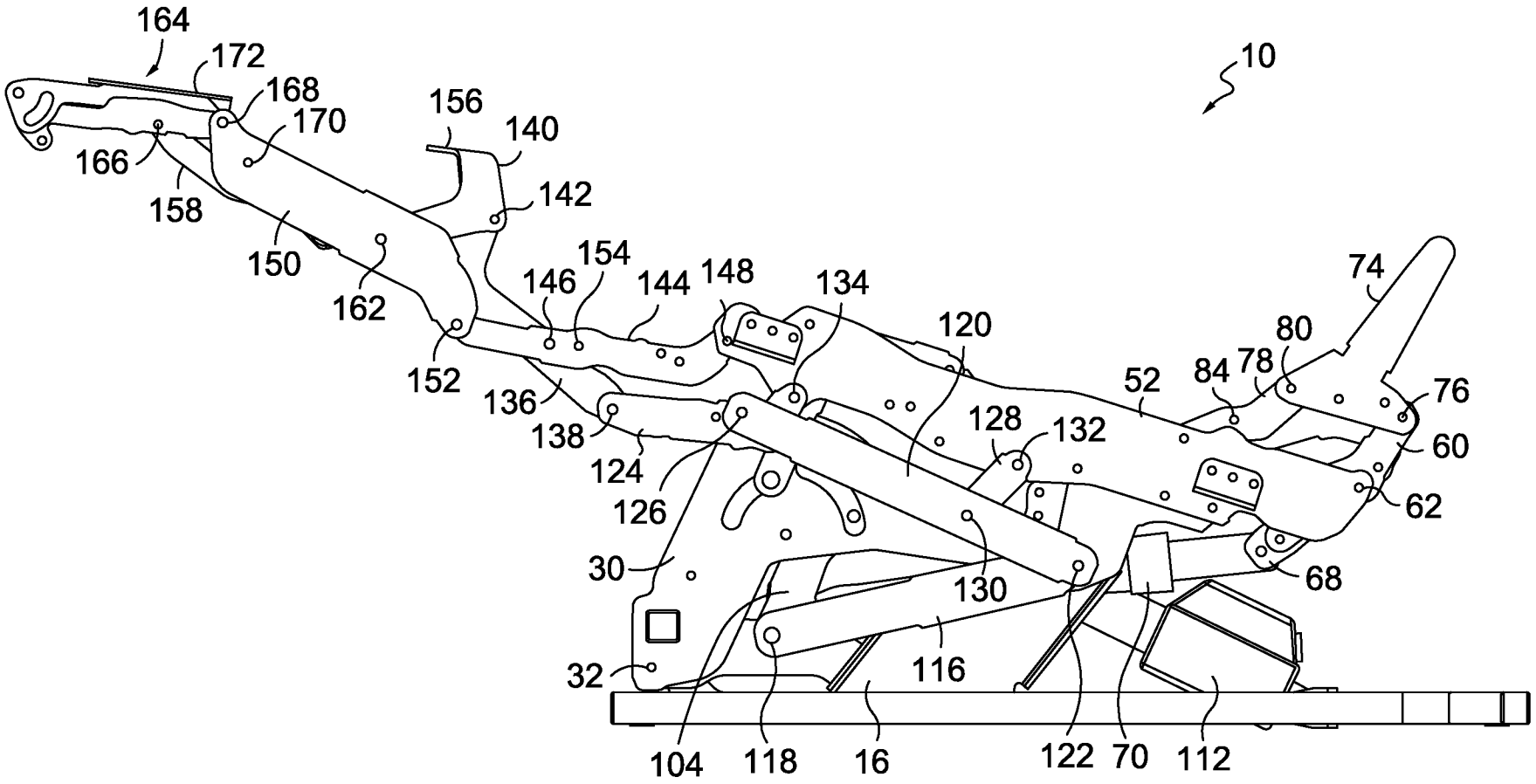
FIG. 6 is a side view of the mechanism of FIG. 4, in accordance with aspects hereof.
Figure 9:
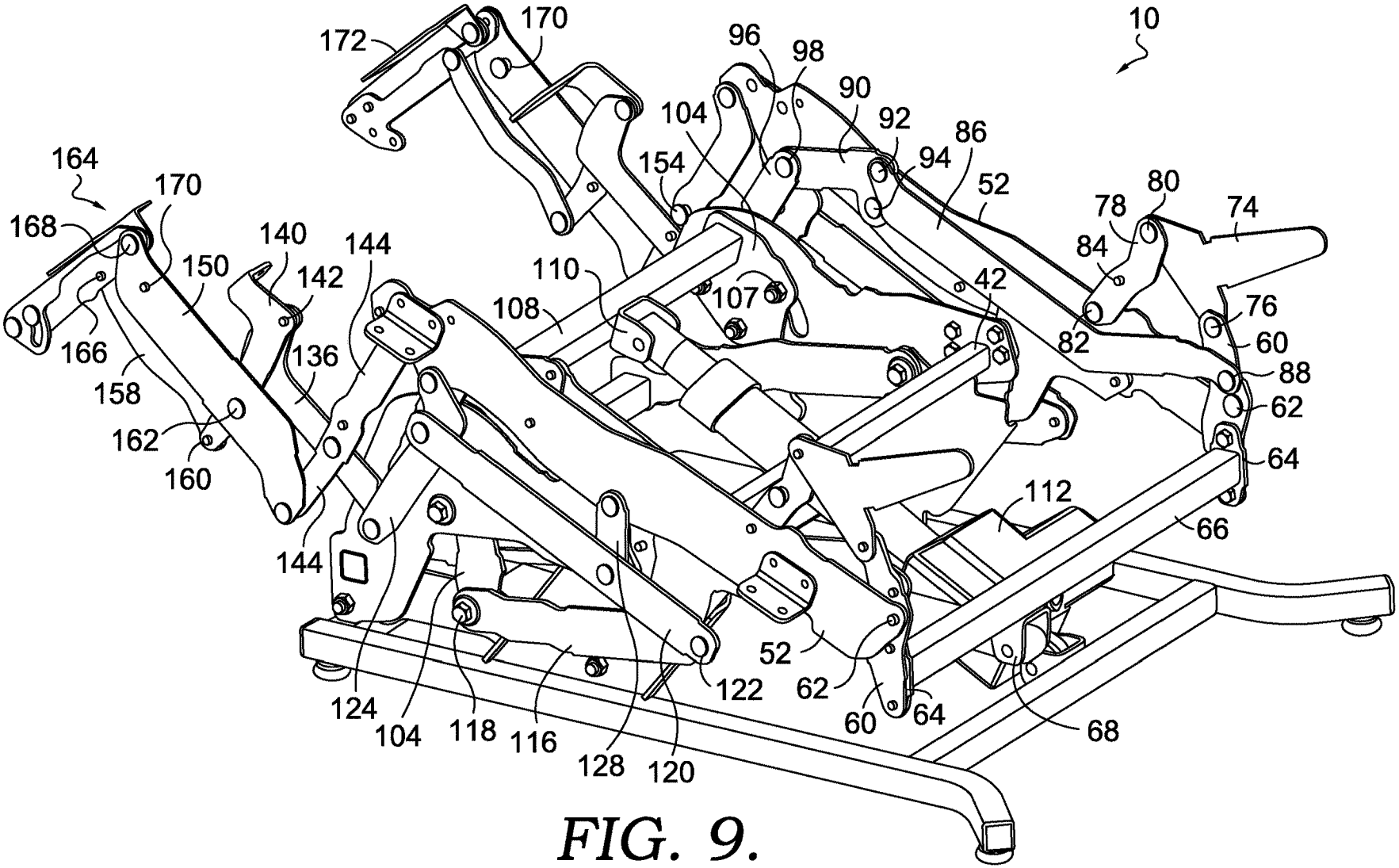
FIG. 9 is a perspective view of the mechanism of FIG. 1, shown in a zero-gravity position with the ottoman partially extended and the back at least partially reclined, in accordance with aspects hereof.
Figure 10:
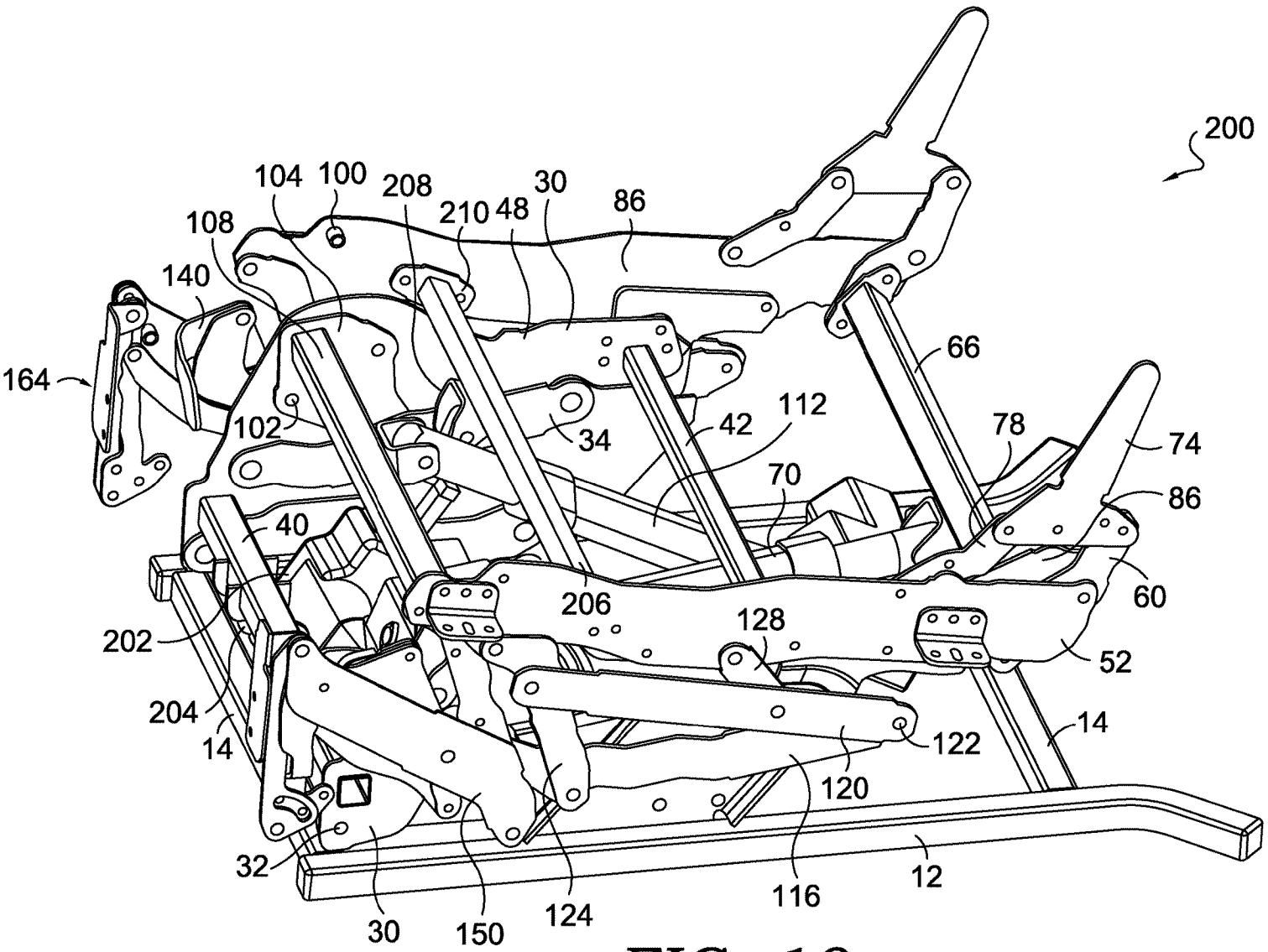
FIG. 10 is a perspective view of a three motor mechanism in a closed position, in accordance with aspects hereof.
Figure 11:
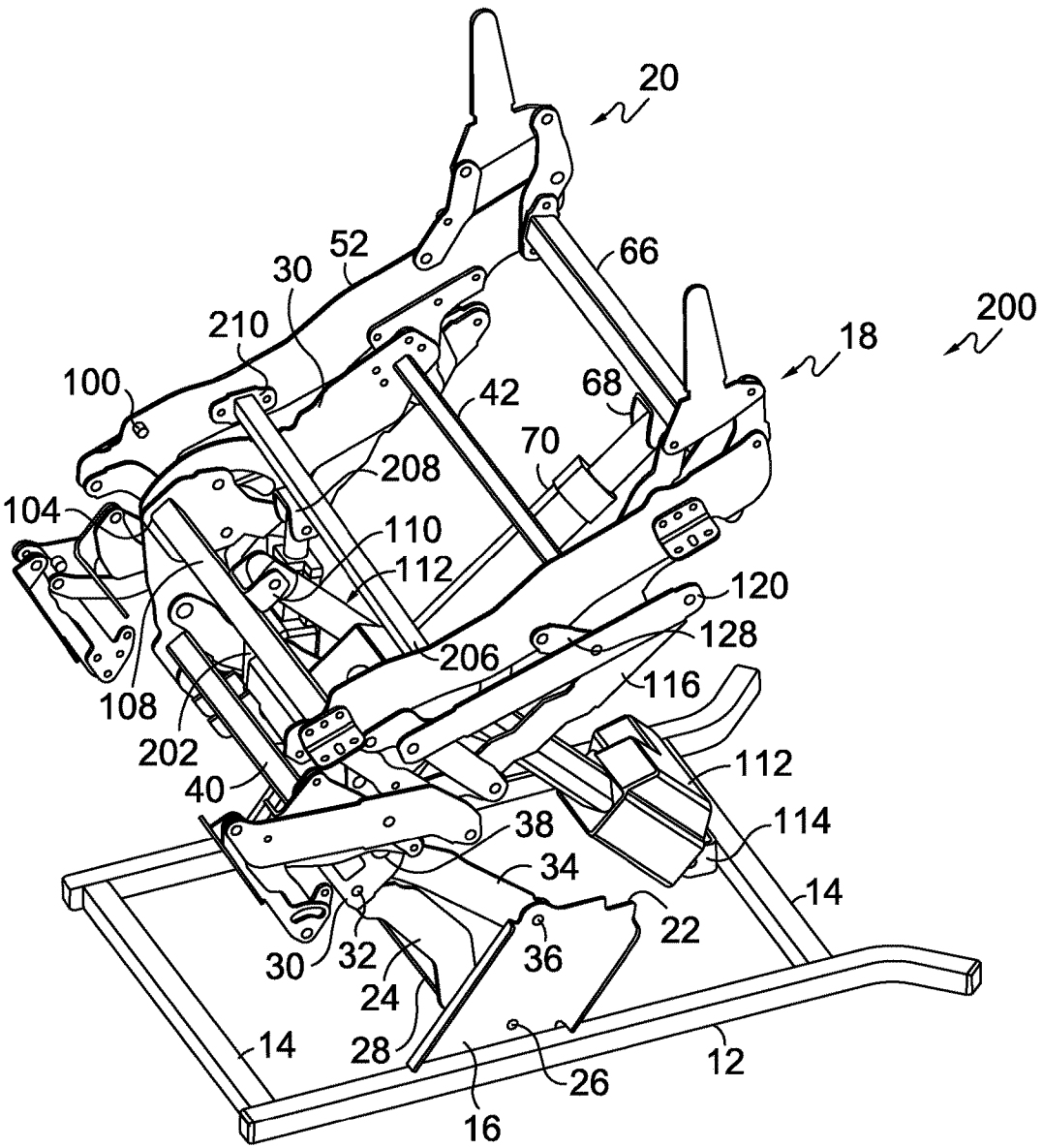
FIG. 11 is a perspective view of the mechanism of FIG. 10, in the lifted position, in accordance with aspects hereof.
Figure 12:
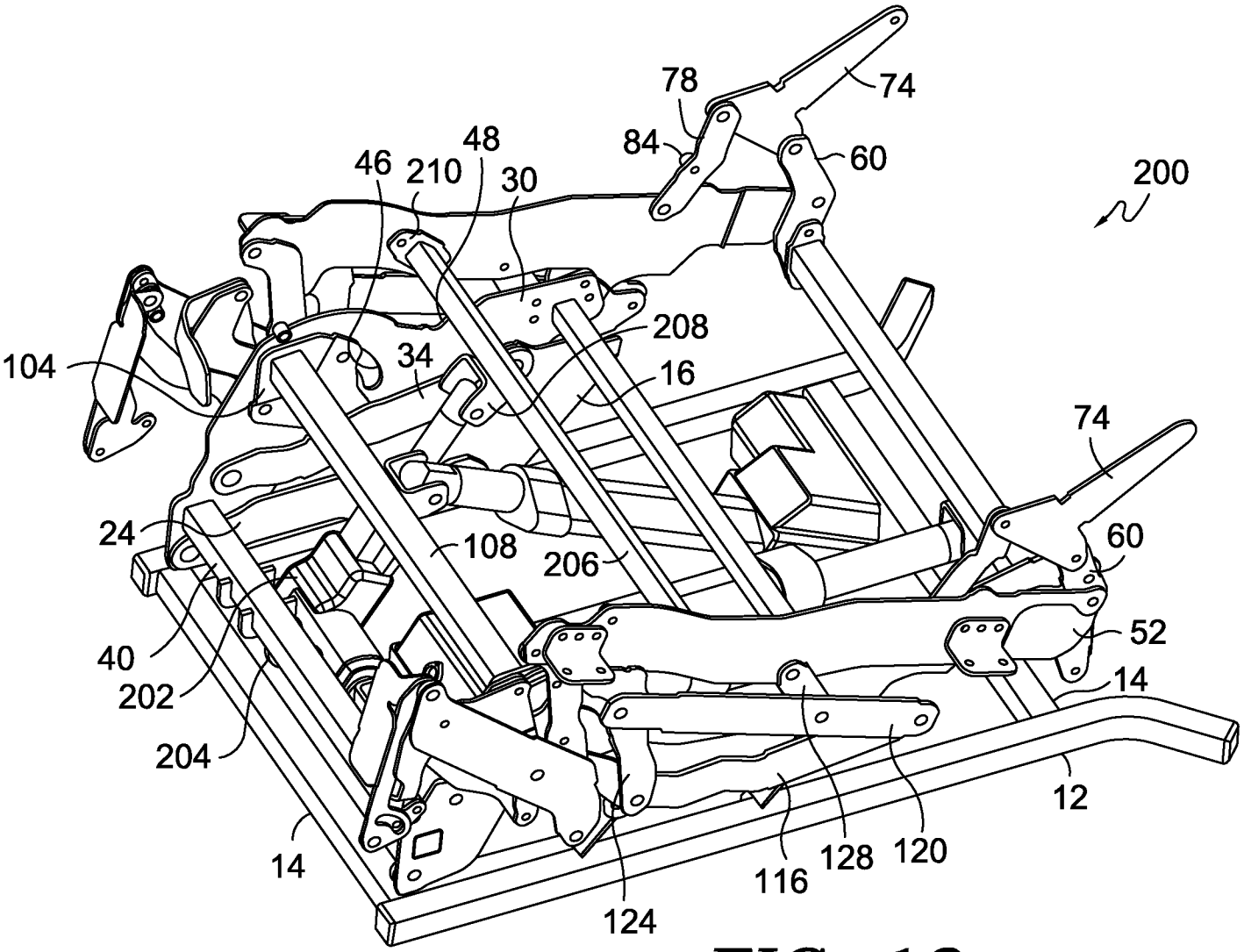
FIG. 12 is a perspective view of the mechanism of FIG. 10 with the seat plate fully-tilted, in accordance with aspects hereof.
Figure 13:
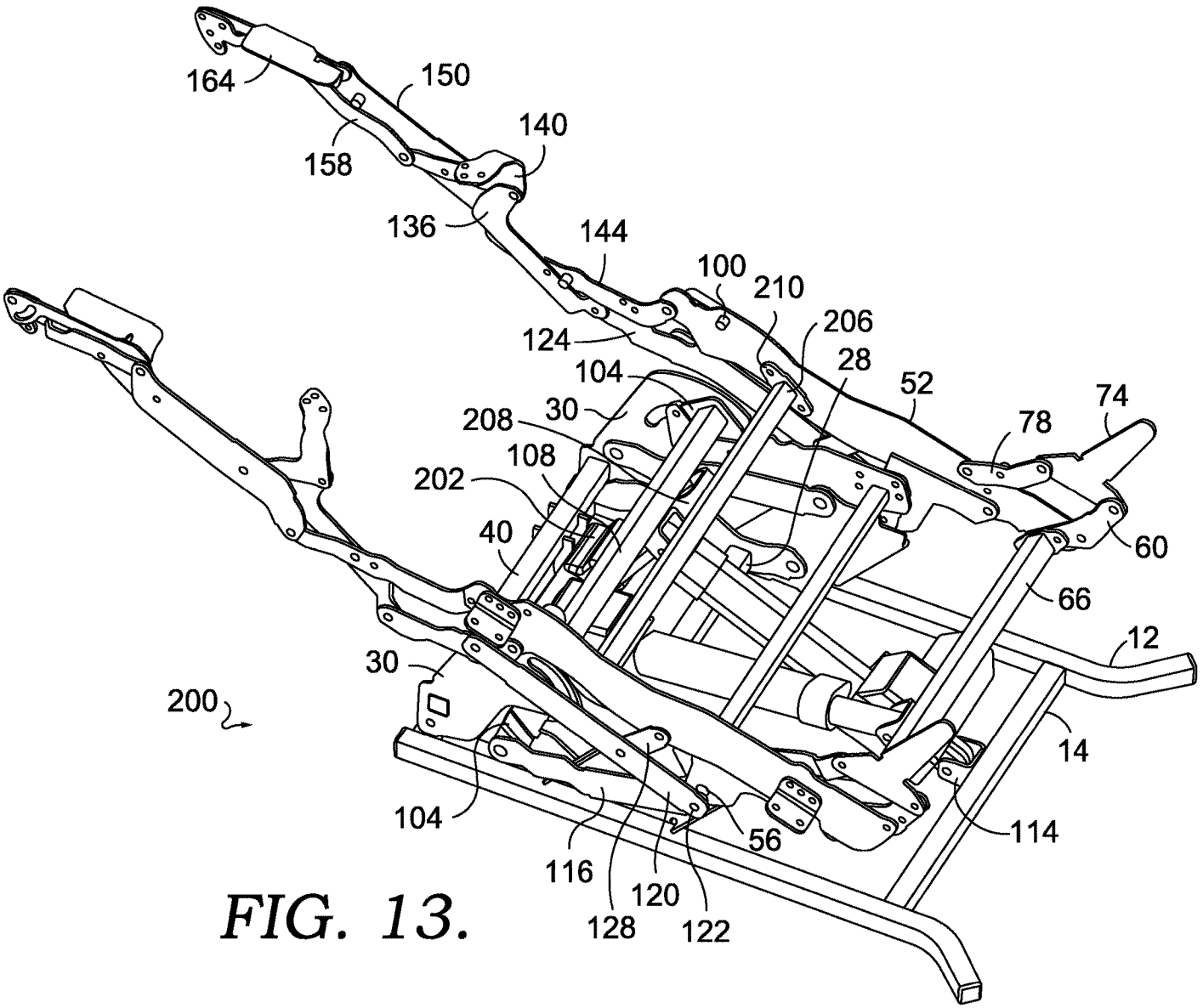
FIG. 13 is a perspective view of the mechanism of FIG. 10 in the TV position, with the ottoman extended, the back reclined and the seat plate tilted, in accordance with aspects hereof.

In some aspects, the mechanism 10 includes a projected pivot back linkage. As seen in FIG. 7, in this arrangement, a back pivot link 60 is pivotally coupled to the seat plate 52 at pivot point 62. The lower end of back pivot link 60 is fixedly coupled to a rear motor tube bracket 64. A rear motor tube 66 is fixedly coupled on each outer end to the rear motor tube bracket 64, such that the rear motor tube 66 extends from one side of mechanism 10 to the other. As best seen in FIG. 6, a clevis 68 is fixedly coupled to the rear motor tube 66. Clevis 68 is used to pivotally couple a shaft of a rear motor 70 to the rear motor tube 66. As best seen in FIG. 5, the other end of rear motor 70 is pivotally coupled to a clevis 72, which is in turn fixedly coupled to the front cross tube 40. Returning to the back linkage and as seen in FIG. 9, the back pivot link 60 is pivotally coupled to a back bracket 74 at pivot point 76, on the end of back pivot link 60 opposite the end coupled to rear motor tube 66. The back bracket 74 is used to attach and support the back of the seating unit, as known to those of skill in the art. The lower, forward end of back bracket 74 is pivotally coupled to a back support link 78 at pivot point 80. The opposite end of back support link 78 is pivotally coupled to the seat plate 52 at pivot point 82. In some aspects, a stop 84 extends outwardly from the back support link 78, and abuts the top of seat plate 52 when the mechanism 10 is in the closed position.

As best seen in FIG. 9, a pitch drive link 86 is pivotally coupled on one end to the back pivot link 60, at pivot point 88 just above the pivot point 62. The pitch drive link 86 extends forwardly from pivot point 88 and is pivotally coupled on the opposite end to a front lift link 90 at pivot point 92. The front lift link 90 is somewhat L-shaped, and is pivotally coupled to seat plate 52 at pivot point 94. The forward end of front lift link 90 is pivotally coupled to a front toggle link 96, at pivot point 98. The forward-most end of front lift link 90 rests against a stop 100 (see FIG. 7) that extends from the seat plate 52 when the mechanism 10 is in the lifted or closed positions with the back upright. As seen in FIG. 8, the lower end of front toggle link 96 is coupled to a pin 102 that is retained within front arcuate slot 44 on side plate 30. As best seen in FIG. 3, the pin 102 is fixedly coupled to a front motor tube bracket 104. The front motor tube bracket 104 is pivotally coupled to the side plate 30 at pivot point 106 (see FIG. 8). A pin 107 is fixedly coupled to the front motor tube bracket 104 that extends into, and is retained within, rear arcuate slot 46 on side plate 30. A front motor tube 108 extends between and is fixedly coupled to each front motor tube bracket 104. The front motor tube 108 has a mounting clevis 110 fixedly coupled thereto that is used to pivotally couple the shaft of a motor 112 to the front motor tube 108. As seen in FIG. 2, the motor 112 is pivotally coupled on the other end to the rear cross-support 14, through a mounting clevis 114. As best seen in FIG. 6, the lower end of the front motor tube bracket 104 is pivotally coupled to a control link 116 at pivot point 118. The other end of the control link 116 is pivotally coupled to an ottoman drive link 120 at pivot point 122.

As best seen in FIG. 6, the ottoman drive link 120 extends forwardly from pivot point 122 and is pivotally coupled to a link on an ottoman linkage 123. More specifically, the ottoman drive link 120 is pivotally coupled on the front end to a lower ottoman swing link 124 at pivot point 126. Between pivot points 122 and 126, the ottoman drive link 120 is pivotally coupled to a control toggle link 128 at pivot point 130. The other end of control toggle link 128 is pivotally coupled to the seat plate 52 at pivot point 132.

The ottoman linkage 123 is best seen in FIG. 6 in the extended position. As shown, the lower ottoman swing link 124 pivotally coupled to the seat plate 52 at pivot point 134. The lower ottoman swing link 124 extends away from pivot point 134, and is pivotally coupled on the other end to a mid-ottoman link 136 at pivot point 138. The end of mid-ottoman link 136 opposite pivot point 138 is pivotally coupled to a mid-ottoman bracket 140 at pivot point 142. Between the pivot point 138 and the pivot point 142, the mid-ottoman link 136 is pivotally coupled to an upper ottoman link 144 at pivot point 146. One end of the upper ottoman link 144 is pivotally coupled to the seat plate 52 at pivot point 148. The opposite end of upper ottoman link 144 is pivotally coupled to a main ottoman link 150 at pivot point 152. As best seen in FIGS. 6 and 9, a stop 154 extends inwardly and away from the upper ottoman link 144 between pivot points 148 and 152, near pivot point 146. The stop 154 abuts the mid-ottoman link 136 when the ottoman linkage is in the extended position. The mid-ottoman bracket 140 has a mounting tab 156 that extends inwardly, and is used to couple a mid-ottoman to the mechanism 10. Additionally, the mid-ottoman bracket 140 extends from pivot point 142, and is pivotally coupled on the other end to a lower ottoman extension link 158 at pivot point 160 (see FIG. 9). The mid-ottoman bracket 140 is also pivotally coupled to the main ottoman link 150 at pivot point 162. The end of the lower ottoman extension link 158 opposite pivot point 160 is pivotally coupled to a front ottoman assembly 164 at pivot point 166. The front ottoman assembly 164 is also pivotally coupled to the main ottoman link 150 at pivot point 168. Near pivot point 168, a stop 170 extends inwardly from the main ottoman link 150. The stop 170 abuts the front ottoman assembly 164 when the ottoman linkage is in the closed position. The front ottoman assembly 164 includes a mounting tab 172 that is used to couple a main ottoman to the linkage mechanism 10. Additionally, the front ottoman assembly 164 may include a spring operated relief construction, as found on other prior linkage mechanisms.

Figure 4:
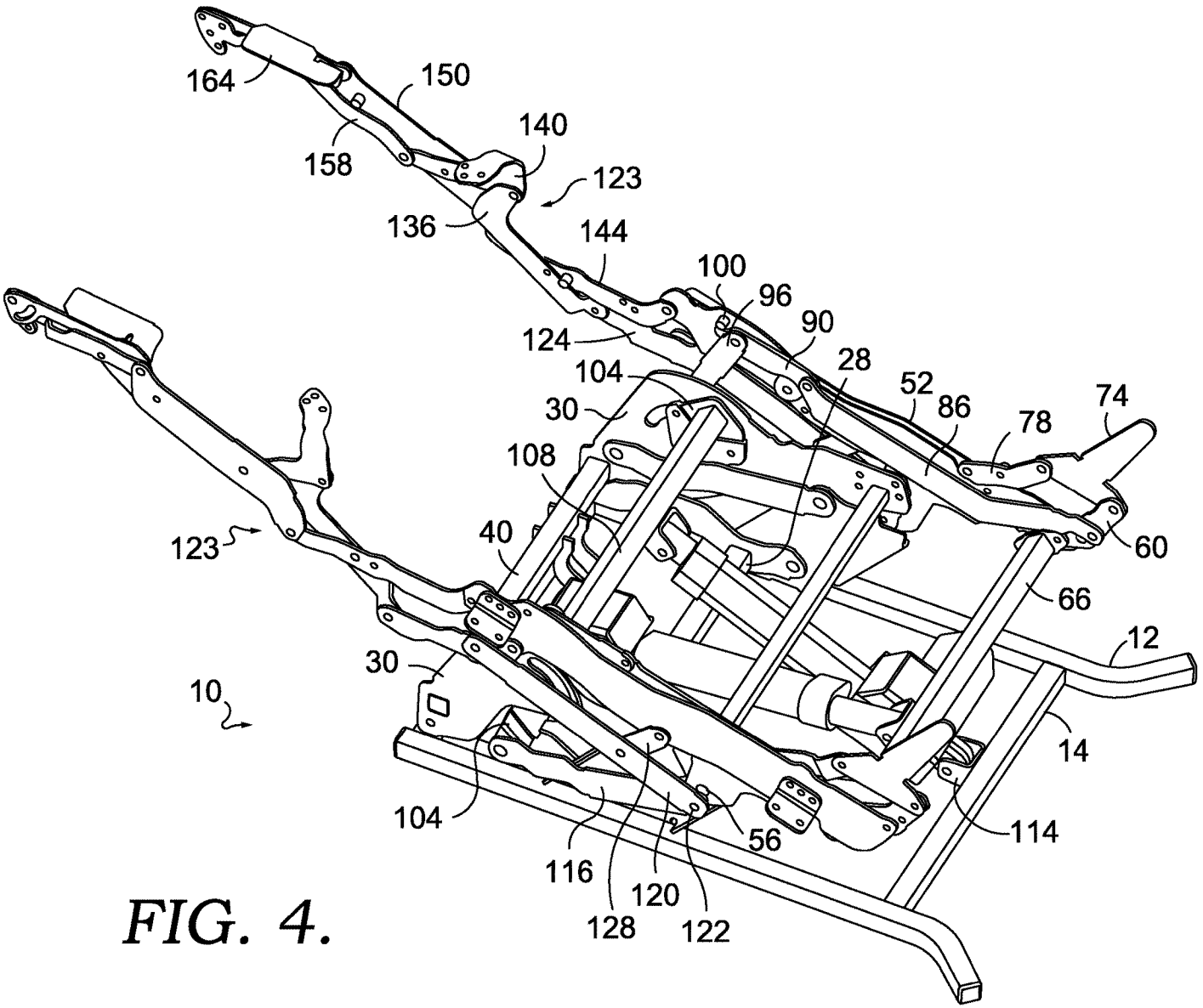
FIG. 4 is a perspective view of the mechanism of FIG. 1, in the TV position, with the ottoman extended and the back upright, in accordance with aspects hereof.

The mechanism 10 can be moved from the closed position of FIG. 1 to the TV position of FIG. 4. From the closed position, the shaft of motor 112 retracts, rotating the front motor tube bracket 104 clockwise (as viewed in FIG. 7) about pivot point 106. In this motion, the pin 107 travels from the top of arcuate slot 46 when the mechanism 10 is in the closed position, to the bottom of arcuate slot 46 when the mechanism 10 is in the TV position. As the front motor tube bracket 104 rotates, it pulls control link 116 forward and downward (see FIG. 6). Movement of the control link 116 operates to move the ottoman drive link 120 forwardly, and the motion of ottoman drive link 120 is also constrained by control toggle link 128. The combined motion of the front motor tube bracket 104, control link 116 and ottoman drive link 120 (as additionally constrained by control toggle link 128) causes the pivot point 122 to overlay and align with pivot point 56, in the TV position, as can be seen in FIG. 4. As the ottoman drive link 120 moves forward, the front ottoman assembly 164 and the mid-ottoman bracket 140 are deployed to the extended position shown in FIG. 4. Additionally, as the mechanism 10 moves to the TV position, the rotation of the front motor tube bracket 104 moves pin 102 from the bottom of arcuate slot 44 to the top of arcuate slot 44. This movement also moves the front toggle link 96 upward, causing the seat plate 52 to rotate about pivot point 56. This results in a seat pitch change of about ten degrees as the mechanism 10 moves from the closed position to the TV position, resulting in an extended ottoman and a reclined seat (reclined from front to back). This position is often found to be more comfortable to users. As described above, the operation of the motor 112 independently extends the ottoman linkage 123 and does not change the position of the back bracket 74.

Operation of the motor 70 independently reclines the back attached to back bracket 74. This operation is possible, without any binding or interference among the various links of mechanism 10, because the pivot points 118, 122 and the pivot point coupling the clevis 68 to the shaft of the motor 70 are all generally in alignment (see FIG. 6). Additionally, when reclining the back with the mechanism 10 in the TV position with the ottoman linkage 123 extended, pivot point 122 overlays pivot point 56. Such a configuration allows the back to move independently from the ottoman, without binding or interference. The shaft of motor 70 can be extended by activating motor 70, rotating back pivot link 60 about pivot point 62. As the back pivot link 60 rotates, it pulls downwardly and forwardly on pivot point 76, thus rotating the back bracket 74 to a reclined position. Additionally, as the back pivot link 60 rotates, it drives pitch drive link 86 forwardly. This movement of pitch drive link 86 rotates front lift link 90 counter-clockwise about pivot point 94 (from the perspective of FIG. 9). The rotation of front lift link 90 lifts pivot point 94 and adds additional seat pitch by rotating seat plate 52 about pivot point 56. In some aspects, the seat pitch change as the back bracket 74 reclines is about ten degrees.

The mechanism 10 can thus be operated to independently extend the ottoman linkage 123, such that the front ottoman assembly 164 and mid-ottoman bracket 140 are in the TV position of FIG. 4. In this position, the seat pitch of seat plate 52 changes about ten degrees, due to the rotation of the front motor tube bracket 104 and the connection to front toggle link 96, front lift link 90 and the rotation of seat plate 52 (through seat plate extension 54) about pivot point 56 on the base bracket 16 (through the pitch bracket 50). The back bracket 74 can also be independently reclined through the operation of motor 70 as described above. This allows the user to adjust the mechanism 10 to a comfortable position. Such a position may include, for example, one where the back bracket 74 is reclined, and the front ottoman assembly 164 is only partially open as shown in FIG. 9. In this position, the seat pitch of seat plate 52 will be reclined about 15 degrees as compared to the seat pitch in the closed position. Ten degrees of seat pitch change results from reclining back bracket 74. About five degrees of seat pitch change results from the partial extension of the ottoman linkage. This allows a user to position mechanism 10 in a "zero-gravity" type position, which many users find comfortable.

The mechanism 10 described above is also a lift mechanism, in that it allows movement from the closed position of FIG. 1 to the lifted position of FIG. 2. To move from the closed position to the lifted position, the motor 112 is activated to extend the shaft of motor 112. Because the pin 107 is at the top of rear arcuate slot 46 when mechanism 10 is in the closed position, extension of the shaft on motor 112 exerts a force on side plate 30, which in turn exerts a rotation force on lower lift link 24 (about pivot point 26) and on upper lift link 34 (about pivot point 36). This motion moves the mechanism 10 to the lifted position of FIG. 2, allowing the user to more easily exit or enter the chair.

As described above, the mechanism 10 shown in FIGS. 1-9 offers a two motor lift mechanism with independent adjustment of the ottoman linkage and the back recline, with a seat pitch change of about ten degrees as the ottoman linkage is extended, and about another ten degrees of seat pitch change as the back is reclined. The mechanism 10 can also be moved to a lifted position. Additionally, the ottoman linkage can be partially extended when the back is reclined to attain a zero-gravity position.

For additional adjustability, a three motor mechanism 200 is described below that allows the seat pitch to be adjusted independently, with an additional motor. In the description that follows with respect to FIGS. 10-14, some parts have the same configuration and connection as described above with respect to the two motor mechanism 10. These parts and connection points are numbered the same, and are not described further.

In the three motor mechanism 200, the linkage of mechanism 10 in the two motor design described above that tilts the seat as the ottoman linkage extends, and as the back reclines, is removed. More specifically, in the three motor mechanism 200, the pitch drive link 86, front lift link 90 and front toggle link 96 are not used. Instead, a seat pitch motor 202 is pivotally coupled to front cross tube 40 via a clevis bracket 204. The shaft of seat pitch motor 202 is pivotally coupled to a seat pitch motor tube 206 via a clevis bracket 208. The seat pitch motor tube 206 extends between opposing seat plates 52, and is fixedly coupled on each end to a respective seat plate 52 through a motor tube bracket 210. The motor tube bracket 210 is fixedly coupled to seat plate 52 in the same area of seat plate 52 as pivot point 94 in the two motor mechanism 10 described above.

In the three motor mechanism 200, the seat plate 52 will not automatically be driven to tilt slightly as the main ottoman link 50 is extended or as the back bracket 74 is reclined (as happens in the two motor mechanism 10). Instead, the seat pitch in the three motor mechanism 200 is operated independently of both the ottoman extension and back recline.

In mechanism 200, the main ottoman link 150 and mid-ottoman bracket 140 are independently adjustable from the seat pitch and back recline, by activating motor 112 to retract the shaft, rotating the front motor tube bracket 104 clockwise (as viewed in FIG. 13) about pivot point 106. In this motion, the pin 107 travels from the top of arcuate slot 46 when the mechanism is in the closed position, to the bottom of arcuate slot 46 when the mechanism 10 is in the TV position. As the front motor tube bracket 104 rotates, it pulls control link 116 forward and downward. Movement of the control link 116 operates to move the ottoman drive link 120 forwardly, and the motion of ottoman drive link is also constrained by control toggle link 128. The combined motion of the front motor tube bracket 104, control link 116 and ottoman drive link 120 (as additionally constrained by control toggle link 128) cause the pivot point 122 to overlay and align with pivot point 56, in the TV position. As the ottoman drive link 120 moves forward, the front ottoman assembly 164 and the mid-ottoman bracket 140 are deployed to the extended position shown in FIG. 13. Because the toggle link 96 is not used in mechanism 200, the pitch or angle of seat plate 52 does not change as the ottoman linkage is extended. As with mechanism 10 described above, the operation of the motor 112 on mechanism 200 independently extends the ottoman linkage and does not change the position of the back bracket 74.

On the mechanism 200, the seat pitch can be independently adjusted from any position. By activating seat pitch motor 202, the shaft can be extended, pushing up on seat pitch motor tube 206 and thus pushing up on seat plate 52 at the location of motor tube bracket 210, causing seat plate 52 to rotate about pivot point 56. Up to about twenty degrees of seat pitch change can be achieved with full extension of the shaft of seat pitch motor 202.

Like mechanism 10, mechanism 200 can be operated to independently recline the back bracket 74, independently of the ottoman linkage. But, in mechanism 200, reclining back bracket 74 is also independent of any seat pitch change. This operation is possible, without any binding or interference among the various links of mechanism 200, because the pivot points 118, 122 and the pivot point coupling the clevis 68 to the shaft of the motor 70 are all generally in alignment. Additionally, when reclining the back with the mechanism 200 in the TV position with the ottoman extended, pivot point 122 overlays pivot point 56. Such a configuration allows the back to move independently from the ottoman, without binding or interference. The shaft of motor 70 can be extended by activating motor 70, rotating back pivot link 60 about pivot point 62. As the back pivot link 60 rotates, it pulls downwardly and forwardly on pivot point 76, thus rotating the back bracket 74 to a reclined position. Because the mechanism 200 does not include pitch drive link 86, the back bracket 74 can be reclined without effecting a change in the seat pitch.

Figure 14:
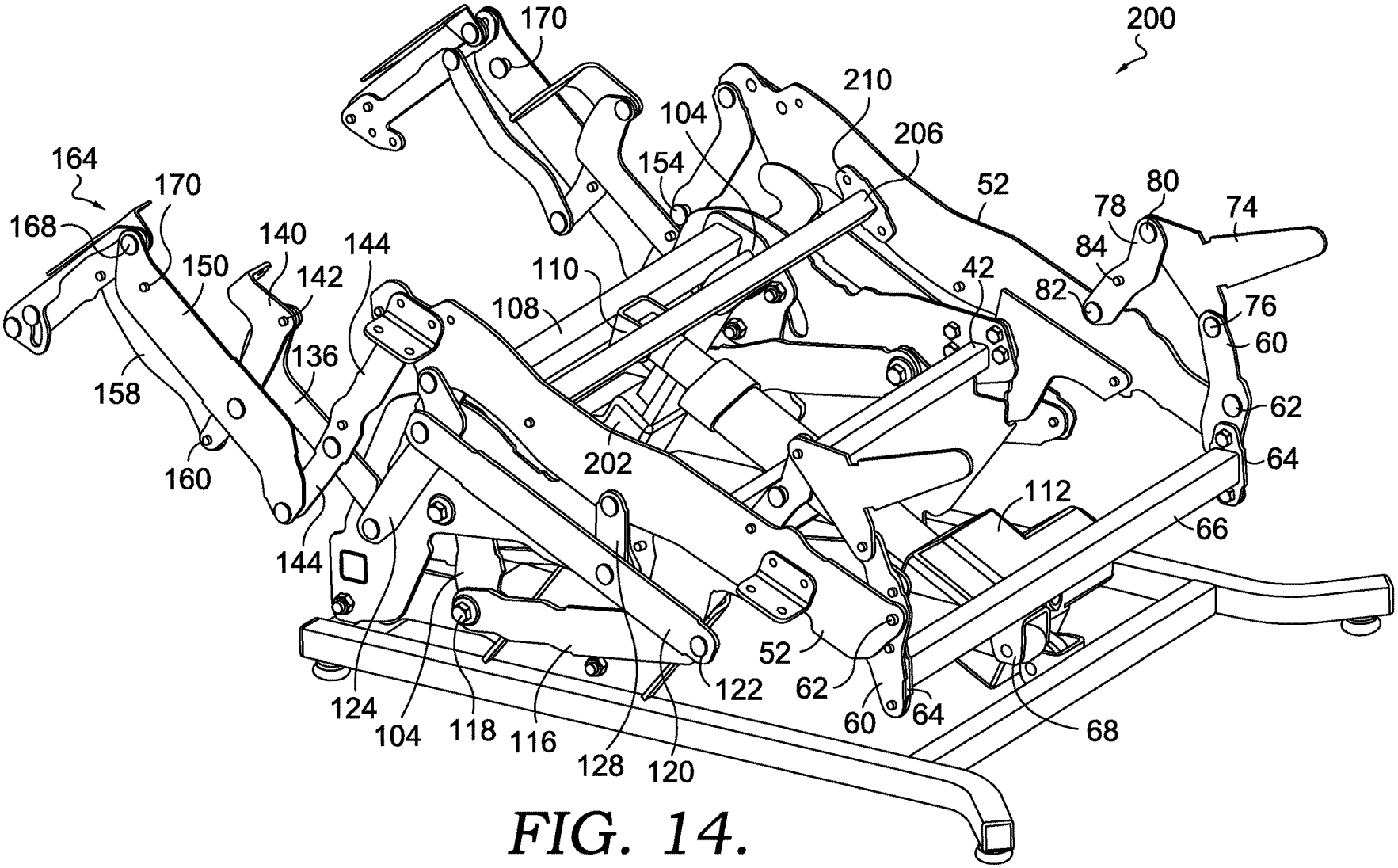
FIG. 14 is a perspective view of the mechanism of FIG. 10 in a zero-gravity position, with the ottoman partially extended and the back reclined, in accordance with aspects hereof.

Mechanism 200 can be moved into a variety of positions due to the independent operation of each of the three motors, moving the ottoman linkage, seat pitch and back recline independently from one another. As one example, mechanism 200 can be moved to a zero-gravity position, with the ottoman linkage partially extended, the seat pitch adjusted so the seat tilts down from front to back, and the backrest reclined, as shown in FIG. 14. To achieve such a position, each of motors 70, 112 and 202 are selectively activated. Like mechanism 10, mechanism 200 can also be moved to a lifted position, when the motor 112 is activated to extend the shaft of motor 112. Because the pin 107 is at the top of rear arcuate slot 46 when mechanism 200 is in the closed position, extension of the shaft on motor 112 exerts a force on side plate 30, which in turn exerts a rotation force on lower lift link 24 (about pivot point 26) and on upper lift link 34 (about pivot point 36). This motion moves the mechanism 10 to the lifted position of FIG. 11, allowing the user to more easily exit or enter the chair.

In both mechanism 10 and mechanism 200, the back assembly is shown with a projected pivot arrangement with back bracket 74 indirectly pivotally coupled to the seat plate 52 through the back pivot link 60 and back support link 78. In other aspects, the back bracket 74 could be directly pivotally coupled to the seat plate 52.

Persons familiar with the field of the invention will realize that it may be practiced by various devices which are different from the specific illustrated embodiments. Therefore, it is emphasized that the invention is not limited only to this embodiment but is embracing of a wide variety of mechanisms which fall within the spirit of the following claims.

What is claimed:

1. A linkage mechanism for a recliner and lift seating unit, comprising:

a base;

a base bracket coupled to the base;

a side plate having a front end and a back end, the side plate pivotally coupled to the base bracket via an upper lift link and a lower lift link;

a front motor tube bracket pivotally coupled to the side plate near the front end of the side plate;

a seat plate pivotally coupled to the side plate, near the rear end of the side plate;

an ottoman linkage pivotally coupled to the seat plate, the ottoman linkage controlling the extension and retraction of an ottoman bracket;

a control link having a first end coupled to the front motor tube bracket and a second end;

a footrest drive link having a first end pivotally coupled to the ottoman linkage, and a second end pivotally coupled to the second end of the control link; and a first motor pivotally coupled on one end to the base, and on the other end to the front motor tube bracket via a front motor tube;

wherein operation of the first motor in a first direction lifts the side plate and seat plate away from the base, and wherein operation of the first motor in a second direction rotates the front motor tube bracket to move the control link and footrest drive link to extend the ottoman linkage to an extended position.

2. The linkage mechanism of claim 1, further comprising a control toggle link pivotally coupled on one end to the seat plate and pivotally coupled on the other end to the footrest drive link, and wherein, when the ottoman linkage is in the extended position, the control toggle link positions the pivot point of the seat plate and side plate in alignment with the pivot point of the control link and footrest drive link.

3. The linkage mechanism of claim 2, further comprising:

a front toggle link having first and second ends, the front toggle link pivotally coupled on the first end to the front motor tube bracket; and a front lift link pivotally coupled to the seat plate, and pivotally coupled to the second end of the front toggle link;

wherein operation of the first motor in the second direction moves the front toggle link upwardly, rotating the front lift link to lift the front end of the seat plate to increase the seat pitch of the seat plate as the ottoman linkage moves to an extended position.

4. The linkage mechanism of claim 3, wherein the seat pitch changes about ten degrees from the closed position to the extended position.

5. The linkage mechanism of claim 3, further comprising:

a back bracket pivotally coupled to the seat plate;

a second motor pivotally coupled on one end to a rear motor tube coupled to the back bracket and pivotally coupled on the other end to a cross tube coupled to the front end of the side plate;

wherein operation of the second motor pivots the back bracket with respect to the seat plate to recline the back bracket; and wherein operation of the first motor is independent of operation of the second motor, allowing the ottoman linkage to extend independently of reclining the back bracket.

6. The linkage mechanism of claim 5, further comprising:

a back pivot link having a first end pivotally coupled to the back bracket and a second end fixedly coupled to the motor tube coupled to the first motor tube, the back pivot link pivotally coupled to the seat plate between the first end and the second end of the back pivot link; and a back support link having a first end pivotally coupled to the seat plate and a second end pivotally coupled to the back bracket; and wherein the pivotal coupling of the back bracket to the seat plate is achieved via the back pivot link and the back support link.

7. The linkage mechanism of claim 6, further comprising a pitch drive link coupled between the front lift link and the back pivot link, wherein operation of the second motor to recline the back bracket moves the pitch drive link and the front lift link to move the front of the seat plate upwardly to increase the seat pitch as the back bracket reclines.

8. The linkage mechanism of claim 7, wherein the seat pitch increases about ten degrees from an upright back bracket position to the reclined back bracket position.

9. The linkage mechanism of claim 7, wherein the first motor can be activated to partially extend the ottoman linkage, and the second motor can be activated to partially recline the back bracket, resulting in a partial seat pitch change and a zero-gravity position.

10. The linkage mechanism of claim 2, further comprising:

a back bracket pivotally coupled to the seat plate;

a second motor pivotally coupled on one end to a rear motor tube coupled to the back bracket and pivotally coupled on the other end to a cross tube coupled to the front end of the side plate; and a third motor pivotally coupled on one end to the cross tube and pivotally coupled on the other end to a seat pitch motor tube that is coupled to the seat plate;

wherein operation of the second motor pivots the back bracket with respect to the seat plate to recline the back bracket;

wherein operation of the third motor pivots the seat plate with respect to the side plate about the pivot point coupling the seat plate and the side plate to change the seat pitch;

wherein operation of the first motor, the second motor and the third motor are each independent, allowing the ottoman linkage extension, the back bracket recline and the seat pitch to be adjusted independently of each other.

11. A linkage mechanism for a recliner and lift seating unit, comprising:

a base;

a base bracket coupled to the base;

a side plate having a front end and a back end, the side plate pivotally coupled to the base bracket via an upper lift link and a lower lift link;

a front motor tube bracket pivotally coupled to the side plate near the front end of the side plate;

a seat plate pivotally coupled to the side plate, near the rear end of the side plate;

an ottoman linkage pivotally coupled to the seat plate, the ottoman linkage controlling the extension and retraction of an ottoman bracket;

a control link having a first end coupled to the front motor tube bracket and a second end;

a footrest drive link having a first end pivotally coupled to the ottoman linkage, and a second end pivotally coupled to the second end of the control link;

a first motor pivotally coupled on one end to the base, and on the other end to the front motor tube bracket via a front motor tube;

a back bracket at least indirectly pivotally coupled to the seat plate;

a second motor pivotally coupled on one end to a rear motor tube coupled to the back bracket and pivotally coupled on the other end to a cross tube coupled to the front end of the side plate;

wherein operation of the first motor in a first direction lifts the side plate and seat plate away from the base, and wherein operation of the first motor in a second direction rotates the front motor tube bracket to move the control link and footrest drive link to extend the ottoman linkage to an extended position;

wherein operation of the second motor pivots the back bracket with respect to the seat plate to recline the back bracket; and wherein operation of the first motor is independent of operation of the second motor, allowing the ottoman linkage to extend independently of reclining the back bracket.

12. The linkage mechanism of claim 11, further comprising a third motor pivotally coupled on one end to the cross tube and pivotally coupled on the other end to a seat pitch motor tube that is coupled to the seat plate, wherein operation of the third motor pivots the seat plate with respect to the side plate about the pivot point coupling the seat plate and the side plate to change the seat pitch.

13. The linkage mechanism of claim 12, wherein operation of the first motor, the second motor and the third motor are each independent, allowing the ottoman linkage extension, the back bracket recline and the seat pitch to be adjusted independently of each other.

14. The linkage mechanism of claim 13, wherein the first motor can be activated to partially extend the ottoman linkage, and the second motor can be activated to partially recline the back bracket, and the third motor can be activated to at least partially change the seat pitch, resulting in a zero-gravity position.

15. The linkage mechanism of claim 12, wherein the third motor can be activated to effect at least about twenty degrees of seat pitch change.

16. A linkage mechanism for a recliner and lift seating unit, comprising:

a base;

a base bracket coupled to the base;

a side plate having a front end and a back end, the side plate pivotally coupled to the base bracket via an upper lift link and a lower lift link;

a seat plate pivotally coupled to the side plate, near the rear end of the side plate;

an ottoman linkage pivotally coupled to the seat plate, the ottoman linkage controlling the extension and retraction of an ottoman bracket;

a back bracket at least indirectly pivotally coupled to the seat plate;

a first motor pivotally coupled between the base and the ottoman linkage to independently extend and retract the ottoman linkage;

a second motor pivotally coupled on one end to the side plates through a cross tube and pivotally coupled on the other end to the back bracket through a rear motor tube to independently control the recline of the back bracket;

wherein operation of the first motor in a first direction lifts the side plate and seat plate away from the base, and wherein operation of the first motor in a second direction rotates the front motor tube bracket to move the control link and footrest drive link to extend the ottoman linkage to an extended position.

17. The linkage mechanism of claim 16, further comprising a third motor pivotally coupled on one end to the cross tube and pivotally coupled on the other end to a seat pitch motor tube that is coupled to the seat plate, wherein operation of the third motor pivots the seat plate with respect to the side plate about the pivot point coupling the seat plate and the side plate to change the seat pitch.

18. The linkage mechanism of claim 17, wherein operation of the first motor, the second motor and the third motor are each independent, allowing the ottoman linkage extension, the back bracket recline and the seat pitch to be adjusted independently of each other.

19. The linkage mechanism of claim 18, wherein the first motor can be activated to partially extend the ottoman linkage, and the second motor can be activated to partially recline the back bracket, and the third motor can be activated to at least partially change the seat pitch, resulting in a zero-gravity position.

* * * * *